US005360713A

United States Patent [19]

Tang et al.

[11] Patent Number: 5,360,713

[45] Date of Patent: Nov. 1, 1994

[54] YELLOW DYE-FORMING COUPLERS AND COLOR PHOTOGRAPHIC ELEMENTS CONTAINING THESE COUPLERS

[75] Inventors: Ping W. Tang; Philip T. S. Lau; Stanley W. Cowan, all of Rochester, N.Y.

[73] Assignee: Eastman Kodak Company, Rochester, N.Y.

[21] Appl. No.: 975,200

[22] Filed: Nov. 12, 1992

[51] Int. Cl.[5] ..... G03C 7/36

[52] U.S. Cl. ..... 430/556; 430/557

[58] Field of Search ..... 430/556, 557

[56] References Cited

U.S. PATENT DOCUMENTS

| | | | |
|---|---|---|---|
| 2,298,443 | 10/1942 | Weissberger | 95/6 |
| 2,407,210 | 9/1946 | Weissberger et al. | 95/6 |
| 2,875,057 | 2/1959 | McCrossen et al. | 96/100 |
| 3,056,675 | 10/1962 | Hoffstadt | 96/55 |
| 3,265,506 | 8/1966 | Weissberger et al. | 96/100 |
| 3,408,194 | 10/1968 | Loria | 96/100 |
| 3,447,928 | 6/1969 | Loria | 96/100 |
| 3,681,076 | 8/1972 | Skoog | 430/556 |
| 4,157,919 | 6/1979 | Lau | 96/100 |
| 4,230,851 | 10/1980 | Renner | 544/183 |
| 4,327,175 | 4/1982 | Toda et al. | 430/546 |
| 4,401,752 | 8/1983 | Lau | 430/385 |
| 4,409,307 | 10/1983 | Lelontal et al. | 430/31 |
| 4,529,691 | 7/1985 | Renner et al. | 430/556 |
| 4,783,397 | 11/1988 | Ogawa et al. | 430/557 |
| 4,994,345 | 2/1991 | Yoshizawa et al. | 430/557 |

FOREIGN PATENT DOCUMENTS

| | | |
|---|---|---|
| 0066226 | 5/1982 | European Pat. Off. . |
| 0365282 | 10/1989 | European Pat. Off. . |

OTHER PUBLICATIONS

Chem. Abstracts Registery Number RN 88185-90-4.

*Primary Examiner*—Lee C. Wright

*Attorney, Agent, or Firm*—Arthur E. Kluegel

[57] ABSTRACT

Yellow dye-forming couplers of the acylacetanilide class, having an electron withdrawing group or electronegative element attached to the keto functional group, have excellent light-absorption characteristics and are useful in photographic elements.

15 Claims, 1 Drawing Sheet

YELLOW DYE-FORMING COUPLERS AND COLOR PHOTOGRAPHIC ELEMENTS CONTAINING THESE COUPLERS

BACKGROUND OF THE INVENTION

1. Field of the Invention

This invention relates to photographic couplers and silver halide photographic materials, in particular to yellow dye-forming couplers useful in silver halide photographic materials, and more particularly to a class of yellow couplers known as acylacetanilides having an electron withdrawing group attached to the keto-functional group, and to their use in silver halide color photographic light-sensitive elements, emulsions, and to processes using such couplers.

2. Description of Related Art

The subtractive process of color formation is customarily employed in multi-colored photographic elements. The resulting yellow, magenta, and cyan image dyes are formed in silver halide layers sensitive to blue, green, and red radiation, respectively.

It is well known in the photographic art that these color images are customarily obtained by a coupling reaction between an oxidized aromatic primary amine developer and a color-forming coupler. It is important that the dye formed from the color-forming couplers have the proper light absorption characteristics. Thus, ideally, the yellow dye should have a high absorption for blue radiation and no or very low absorption for green and red radiation.

Typically, yellow dye-forming couplers are open-chain ketomethylene compounds which yield azomethine dyes upon coupling with oxidized developers. The most common yellow dye-forming couplers are acylacetanilides such as pivaloylacetanilides and benzoylacetanilides. Representative couplers of these classes are described in U.S. Pat. Nos. 2,298,443; 2,407,210; 2,875,057; 3,048,194; 3,265,506; 3,447,928; 4,157,919; 4,230,851; 4,327,175; 4,401,752; and 4,529,691. Furthermore, "Farbkupplereine Literaturubersicht" published in Agfa Mittelunger, Band II, pp 112–126 (1961) describes such couplers.

Furthermore, U.S. Pat. No. 3,056,675 describes benzoyl acetanilide couplers of the formula:

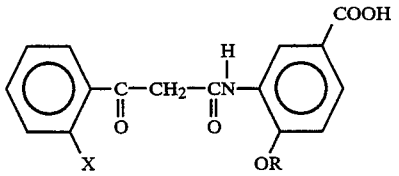

wherein X is a halogen. These benzoylacetanilide type couplers are not within the scope of the couplers of the present invention because "X" is not on a carbon adjacent to the carbonyl.

These known yellow dye-forming couplers frequently used in the photographic art often do not possess the absorption characteristics discussed above to the desired extent. In particular, they absorb not only blue light, but often undesirable quantities of green and red light. For instance, some of the known yellow-dye forming couplers are orange-colored because they have unwanted absorption in the green and the red portion of the spectrum. Furthermore, pivaloylacetanilide yellow couplers of the structure

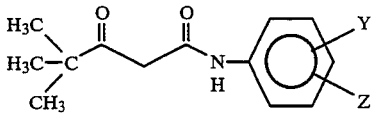

have in general low coupler efficiency due to their high pKa value and benzoylacetanilide yellow couplers of the structure

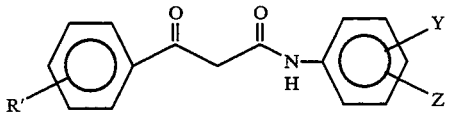

form yellow image dyes with very poor light fastness.

Accordingly, there has been a need to find yellow-dye forming couplers which improve upon existing couplers and optimize photographic properties such as the light absorption characteristics discussed above. In particular, it would be highly desirable to develop a yellow-dye forming coupler which substantially absorbs only blue light, with minimal or no absorption of green and red light.

There is further a need to provide a silver halide color photographic element containing yellow dye-forming couplers having these beneficial light absorption characteristics and to provide a process of using such an element.

SUMMARY OF THE INVENTION

These and other needs have been satisfied by providing, in accordance with one aspect of the invention, a photographic element comprising a support and a silver halide emulsion layer having associated therewith a yellow image dye-forming coupler having the structure I

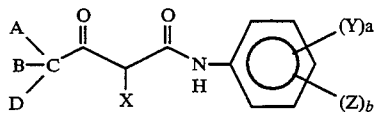

I.

wherein at least one of A, B, and D is an electronegative atom or an electron-withdrawing group, X is a hydrogen atom or coupling-off group, and Y and Z are independently selected from the group consisting of H, Cl, F, Br, CN, carboxy, $NO_2$, $CF_3$, substituted or unsubstituted alkoxycarbonyl, substituted or unsubstituted aryloxycarbonyl, $—S(O)N(R^2)_2$, $—S(O)_2N(R^2)_2$, $—S(O)R^3$, $—S(O)_2R^3$, $—NR^2S(O)R^3$, $—NR^2S(O)_2R^3$, $—NHCONHR^3$, $NHCOR^3$, $—NR^2S(O)N(R^2)_2$, $—NR^2S(O)_2N(R^2)_2$, $—OR^3$, $—OCR^1(R^2)_2$, $—O(CH_2)_nR^3$, $—O(CH_2—CH_2—O)_nR^2$, $—O(CH_2—CH_2—O)_nCOOR^2$, $—O(CH_2—CH_2—O)_nCON(R^2)_2$, $—CR^1R^2COOR^2$, $—CR^1R^2CON(R^2)_2$, $—COO(CH_2—CH_2—O)_nR^2$ and a ballast group; where each $R^1$, $R^2$ or $R^3$ independently is hydrogen, alkyl, alkoxy, aryl or aryloxy, any of which may be substituted or unsubstituted; and n is an integer, preferably 1 or 2, and wherein a and b are independently integers from 1 to 4.

In accordance with another aspect of the present invention, there is provided a yellow-dye forming coupler having the above structure and a process for preparing the coupler.

There is further provided a yellow dye-forming coupler as described above in which X is $$-(TG)_x-(PUG)$$

wherein TG is a timing group, cleavable from the rest of the coupler during processing, x is 0, 1, 2, or 3, and PUG is a releasable photographically useful group.

There is further provided in accordance with the present invention a silver halide emulsion having associated therewith a yellow dye-forming coupler as described above.

In accordance with another aspect of the present invention, there is provided a multi-color photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, wherein the element further comprises, preferably in a yellow dye image-forming unit, a yellow dye-forming coupler having the above structure.

There is also provided a process for developing an image in a photographic element comprising a support and a silver halide emulsion containing an image-wise distribution of developable silver halide grains, said process comprising the step of developing said element with a silver halide color developing agent in the presence of a coupler having a structure described above.

Further objects, features, and advantages of the present invention will become apparent from the detailed description of preferred embodiments that follows.

DETAILED DESCRIPTION OF THE PREFERRED EMBODIMENTS

Figure 1:
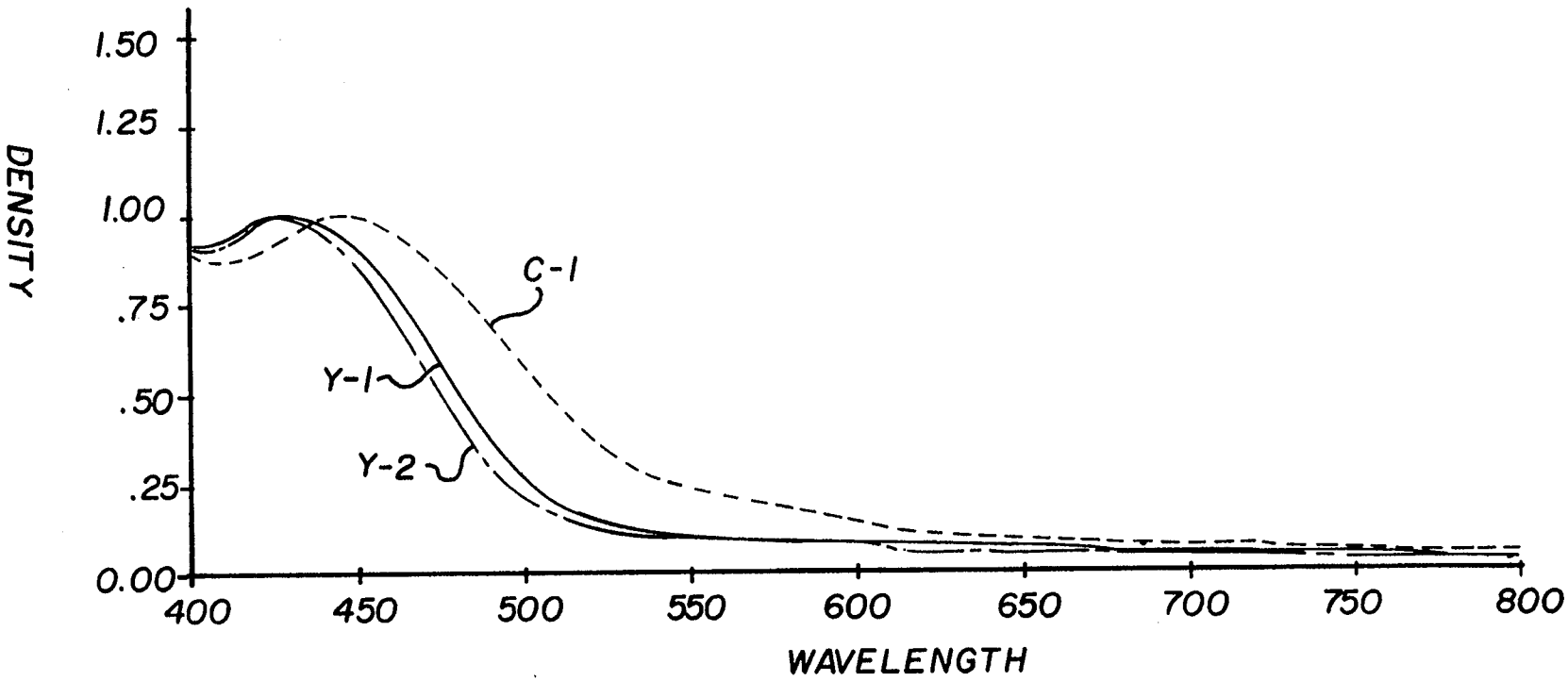
FIG. 1 shows the absorption of the dyes formed from the two couplers Y-1 and Y-2 according to the invention as compared with a comparison coupler, C-1, when the couplers are coated and processed as described herein in Examples 1, 2, and 3.

It has now been discovered that yellow dye-forming couplers of the structure of formula I can meet the above-mentioned objective of having excellent properties, such as light absorption characteristics. That is, the dyes formed from the yellow couplers of the present invention have very low absorptions for green and red radiation. Furthermore, as seen in FIG. 1, the yellow dyes of this invention exhibit a good toe cut on the longer wavelength side. These characteristics are very desirable for color reproduction in the photographic art. The pivaloylacetanilide yellow couplers, as demonstrated by the comparative example which follows, do not possess these good characteristics to the desired extent.

Unlike the pivaloylacetanilide and the benzoylacetanilide classes of yellow dye-forming couplers which have bulky, fully substituted tert-butyl and aryl substituents attached to the keto-functional group, the couplers of the present invention contain an electron withdrawing group or electronegative element attached to the keto-functional group.

In formula I,

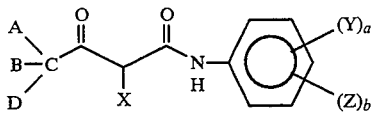

A, B and D may be the same or different, and at least one represents an electronegative element or an electron-withdrawing group. Any known electronegative element or electron withdrawing group can be used. Examples of these include F—, $C_nF_{2n+1}$—; $C_nF_{2n+1}$—; $CH_3$—$(CF_2)_n$—; $R^3$—$(CF_2)_n$—; and $C_nF_{n-1}$—. In each case n is an integer, generally from 1 to 6, and $R^3$ is a unsubstituted or substituted alkyl or aryl. Other useful groups include, but are not limited to Cl, Br, $NO_2$, CN, —$SO_2R^3$,

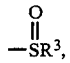

and $CO_2R^3$.

Any of A, B, or D which are not electronegative elements or electron-withdrawing groups may be selected from groups which do not adversely affect the coupler during processing, such as alkyl and aryl groups, either of which may be substituted.

Examples of useful

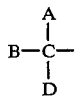

groups include $CF_3$;

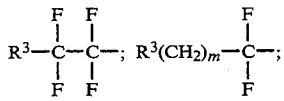

wherein m=1 to 6, and $R^3$ is a substituted or unsubstituted aliphatic or aromatic moiety. The optional substituents of $R^3$ may be any known in the art so long as they do not adversely affect the coupler during processing. If $R_3$ is an aromatic moiety, preferred substituents are electronegative elements, such as fluorine.

Further examples of useful

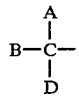

groups include

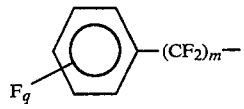

wherein: q denotes 0 to 5, and M is an integer from 1 to 6, inclusive, e.g.,

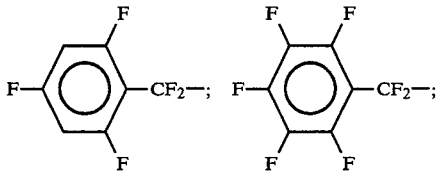

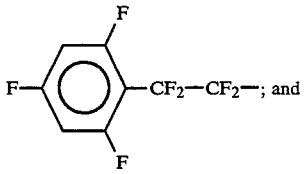

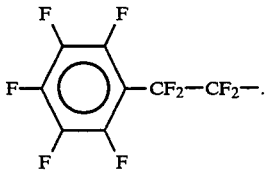

Preferably each of A, B, and D is an electron-withdrawing groups. More preferably, at least one of A, B and D contains a fluorine atom. Most preferably each of A, B and D are fluorine. The resulting $CF_3$ group is unique by virtue of its strong electron-withdrawing character and its relatively small size as compared to t-butyl groups used in conventional pivaloylacetanilide yellow dye-forming couplers.

In formula I, X is a hydrogen atom or coupling-off group. Any coupling-off group known in the art can be used. Examples of useful X groups include H, halogen, substituted or unsubstituted aryloxy, substituted or unsubstituted alkoxy, substituted or unsubstituted acyloxy and nitrogen heterocyclic compounds. Any substituent for the X group can be used as long as it does not adversely effect the coupler during processing. As seen in the formula for coupler Y-10, below, the coupling-off group can be linked to one of the substituents, Y or Z.

Preferred X groups are: H, Cl F, Br,

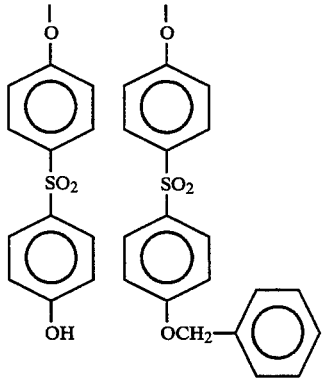

-continued

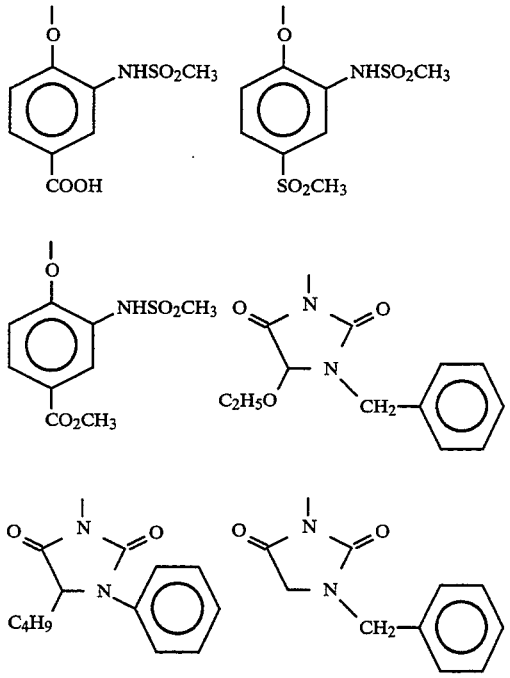

Y and Z may be the same or different and are independently selected from the group consisting of H, Cl, F, Br, CN, carboxy, $NO_2$, $CF_3$, substituted or unsubstituted alkoxycarbonyl, substituted or unsubstituted aryloxycarbonyl, $—S(O)N(R^2)_2$, $—S(O)_2N(R^2)_2$, $—S(O)R^3$, $—S(O)_2R^3$, $—NR^2S(O)R^3$, $—NR^2S(O)_2R^3$, $—NHCONHR^3$, $NHCOR^3$, $—NR^2S(O)N(R^2)_2$, $—NR^2S(O)_2N(R^2)_2$, $—OR^3$, $—OCR^1(R^2)_2$, $—O(CH_2)_nR^3$, $—O(CH_2—CH_2—O)_nR^2$, $—O(CH_2—CH_2—O)_nCOOR^2$, $—O(CH_2—CH_2—O)_nCON(R^2)_2$, $—CR^1R^2COOR^2$, $—CR^1R^2CON(R^2)_2$, $—COO(CH_2—CH_2—O)_nR^2$ and a ballast group. Any known ballast group can be used, as discussed fully hereinafter.

Each $R^1$, $R^2$, and $R^3$ independently is hydrogen, alkyl, alkoxy, aryl or aryloxy, any of which may be substituted or unsubstituted; and n is an integer, preferably 1 or 2.

Alkyl, or the alkyl moiety in an alkoxy group, denotes a $C_{1-30}$ straight, branched or alicyclic, saturated or unsaturated group, preferably a $C_{1-20}$ group, Aryl or the aryl moiety in an aryloxy group, denotes an aromatic carbocyclic or heterocyclic ring system, preferably a 6-membered, 10-membered or 14-membered carbocyclic ring system, e.g., phenyl, naphthyl, anthracenyl, phenanthrenyl, or heterocyclic ring system, such as pyridyl, quinolyl, pyranyl, or coumaronyl. Any of these groups may be substituted with substituents which do not adversely affect the coupler during processing.

Examples of preferred substituents Y and Z are found in the following exemplified couplers and include:

$—Cl$, $—OCH_3$, $—OC_2H_5$, $—OC_3H_7\text{-i}$, $—SO_2NH—C_{16}H_{33}$, $—NH—SO_2C_{16}H_{33}$, $—CO_2C_{12}H_{25}$, $—NH—CO—CH(CH_3)—CH_2—SO_2C_{12}H_{25}\text{-n}$, -continued
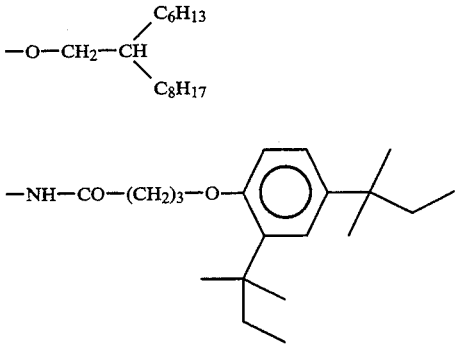
(a) and (b) are independently integers from 1 to 4. Accordingly, up to five substituents can be present on the ring.
Examples of preferred couplers according to the invention are as follows.
Y-1)
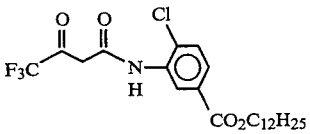
Y-2)
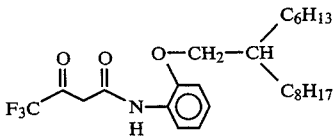
Y-3)
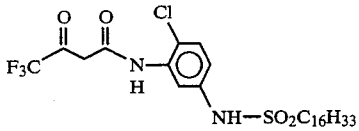
Y-4)
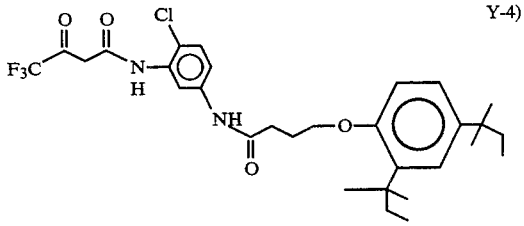
Y-5)
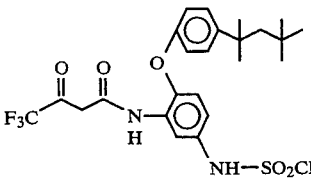
Y-6)
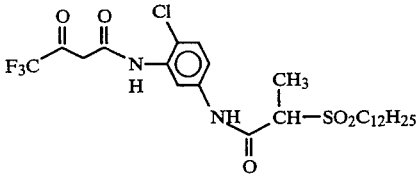
-continued
Y-7)
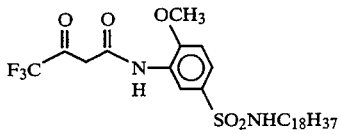
Y-8
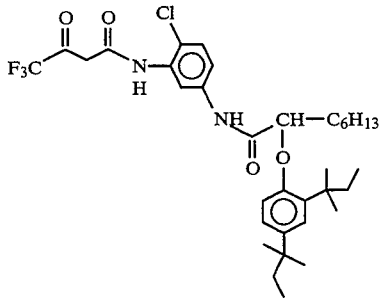
Y-9
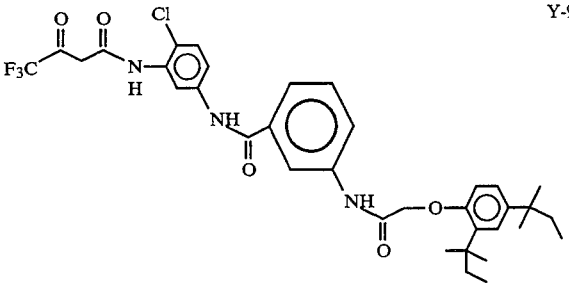
Y-10)
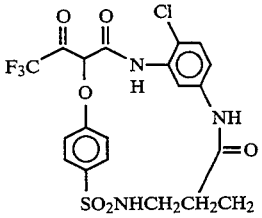
Y-11)
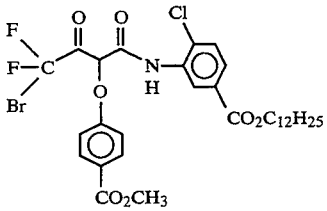
Y-12)
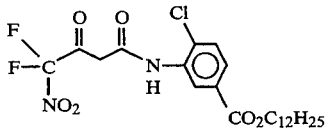
Y-13)
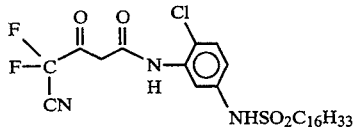
Y-14)
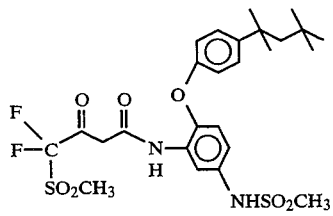

-continued

Y-15)

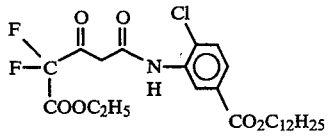

Y-16)

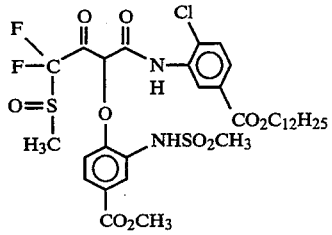

Y-17)

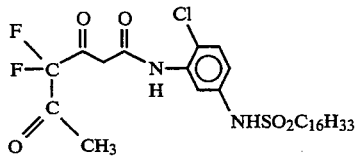

The novel yellow dye-forming couplers as described are generally prepared by the following general method of synthesis (scheme 1); although other methods can be used.

Scheme 1

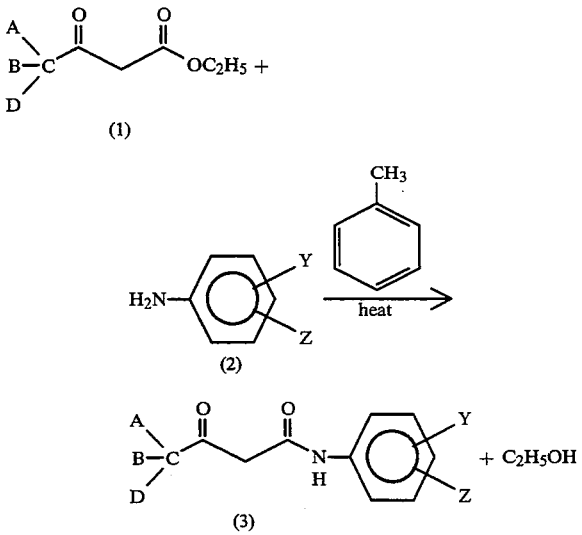

Compounds of structure (1) are commercially available and/or can be synthesized by methods known in the art.

SYNTHESIS EXAMPLE

Illustrative Example

An example of synthesis of a coupler as described is as follows:

Preparation of Dodecyl 4-chloro-3-[(4,4,4-trifluoro-1,3-dioxobutyl)amino] benzoate. Yellow coupler Y-1.

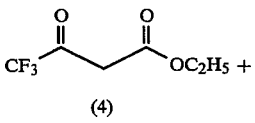

-continued

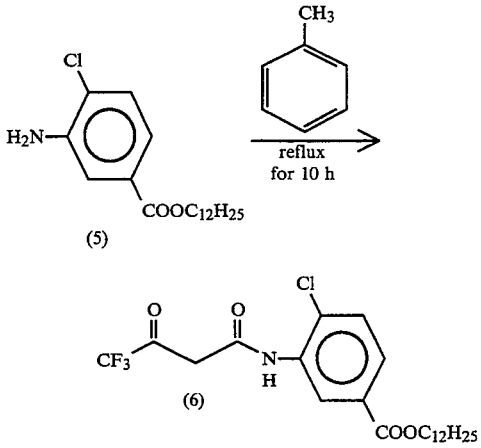

A mixture of 55.23 g (0.30 mol; 1 equiv.) of ethyl 4,4,4-trifluoroaceto-acetate (4) and 101.907 g (0.30 mol; 1 equiv.) of dodecyl 3-amino-4-chlorobenzoate (5) in 250 mL of toluene was heated at gentle reflux for 10 hours. Thin layer chromatography (TLC) showed the disappearance of the starting materials. The reaction mixture was cooled to about 40° C. and the solvent was removed in vacuo. The crude product was purified by flash chromatography (silica gel, $CH_2Cl_2$/ligroin: 1/1) to yield 78.86 g (55%) of the desired coupler (1) as a light brown oil which solidified to a waxy solid upon standing at room temperature. All of the analytical data confirmed the assigned structure.

The invention also relates to the use of the above described couplers in molecules from which photographically useful groups can be released. Such molecules are of the structure described above, in which X is $$-(TG)_x-PUG$$

TG is a timing group, cleavable from the rest of the coupler during processing, x is 0, 1, 2, or 3, and PUG is a releasable photographically useful group.

Any timing group which is known in the photographic art is useful as the timing groups TG. Exemplary timing groups are disclosed in U.S. Pat. Nos. 4,248,962, 4,772,537, 5,019,492, and 5,026,628 and European Patent Application No. 255,085. Up to three timing groups can be joined sequentially (that is, x is 0 to 3). The timing group can be unballasted or ballasted, and can contain solubilizing groups.

The ballast can be any group of sufficient size and bulk that, with the remainder of the molecule, renders the unreacted molecule immobile or non-diffusible in the photographic element prior to processing. It can be a relatively small group if the remainder of the molecule is relatively bulky. Preferably, the ballast is an alkyl or aryl group, each containing about 8 to 30 carbon atoms. These groups can be substituted or unsubstituted with groups which, for example, enhance the nondiffusability of the coupler prior to development. A ballast can be attached in any way to the coupler, such as to the TG and/or the PUG. The ballast can also contain additional solubilizing groups such as carboxylic acids or sulfonamides. Suitable ballast groups are described in, for example, U.S. Pat. Nos. 4,420,556 and 4,923,789, which are incorporated herein by reference. These ballast groups are also useful as Y and/or Z in the above formula I.

Useful PUGs include any known in the art, such as development inhibitors, dyes, dye precursors, additional couplers, developing agents, development accelerators, bleach inhibitors, bleach accelerators, stabilizers, nucleators, fixing agents, complexing agents, image toners, image stabilizers, tanning agents, solvents, surfactants, chemical and spectral sensitizers, hardeners, fogging agents, antifoggants, UV absorbers and stabilizers, and other additives known to be useful in photographic materials. These PUGs are well known in the art, and are described, for example, in U.S. Pat. Nos. 5,019,492 and 5,026,628, which are both incorporated herein by reference in their entireties.

The novel couplers of the present invention can be used as masking couplers in a layer of a photographic material. Masking couplers are compounds which mask a layer of a photographic element from unwanted wavelengths of light. When used as a masking coupler, a coupler wherein X has the above structure -(TG)hd x-PUG is used wherein PUG is a dye. The type of dye is selected, as is known, so as to facilitate the desired masking. The dye may be attached to TG, or directly to the coupler if x is zero, at any location except through the auxochrome of the dye. The auxochromic group of the dye may be blocked by any removable group known in the art. The hue shift can then be controlled by blocking and unblocking the dye, so that the desired masking effect is obtained without the absorption of unwanted light which often results in a speed loss in the color of the absorbed light. The blocking group may be any group which is removable during processing. Examples of useful blocking groups are disclosed in UK Patent Application 2,105,482, with particularly effective blocking groups described in U.S. Pat. No. 5,019,492.

The couplers of the present invention can be incorporated in silver halide emulsions and the emulsions can be coated on a support to form a photographic element. The amount of coupler added can be varied depending on the intended use of the coupler, but generally is an amount conventionally used for couplers in the photographic art, such amounts being known to those of ordinary skill in the art.

Alternatively or additionally, the coupler can be incorporated in the photographic element adjacent to the silver halide emulsion where, during development, the coupler will be in reactive association with development products such as an oxidized color developing agent. More than one of the couplers may be present in a single layer of a film or throughout the film.

The term "associated" used in the instant specification means that the coupler is either incorporated in a silver halide layer or incorporated in a photographic element, such that during development the coupler will be able to react with development products, such as an oxidized color developing agent.

The photographic elements in which the couplers and molecules of this invention are employed can be either single color or multi-color elements. Multi-color elements contain dye image-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. When used as a masking coupler, the coupler is located in a layer of the film which is intended to be masked.

A typical multi-color photographic element comprises a support bearing a cyan dye image-forming unit comprising at least one red-sensitive silver halide emulsion layer having associated therewith at least one cyan dye-forming coupler, a magenta image forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, such as the coupler described above. The element can contain additional layers, such as filter layers, interlayers, overcoat layers, subbing layers, and the like.

In the following discussion of suitable materials for use in the emulsions and elements according to the invention, reference will be made to Research Disclosure, December 1989, Item 308119, published by Kenneth Mason Publications, Ltd., Emsworth, Hampshire P010 7DQ, U.K., the disclosures of which are incorporated herein in their entireties by reference. This publication will identified hereafter as "Research Disclosure". The elements of the invention can comprise emulsions and additives described in these publications and publications referenced therein.

The silver halide emulsions employed in the elements according to the invention can comprise silver bromide, silver chloride, silver iodide, silver chlorobromide, silver chloroiodide, silver bromoiodide, silver chlorobromoiodide, or mixtures thereof. The emulsions can include silver halide grains of any conventional shape or size. Specifically, the emulsions can include coarse, medium, or fine silver halide grains. High aspect ratio tabular grain emulsions are specifically contemplated, such as those disclosed by Mignot, U.S. Pat. No. 4,386,156; Wey, U.S. Pat. No. 4,399,215; Maskasky, U.S. Pat. No. 4,400,463; Wey et al., U.S. Pat. No. 4,414,306; Maskasky, U.S. Pat. No. 4,414,966; Daubendiek et al., U.S. Pat. No. 4,424,310; Solberg et al., U.S. Pat. No. 4,433,048; Wilgus et al., U.S. Pat. No. 4,434,226; Maskasky, U.S. Pat. No. 4,435,501; Evans et al., U.S. Pat. No. 4,504,570; and Daubendiek et al., U.S. Pat. Nos. 4,672,027 and 4,693,964. Also specifically contemplated are those silver bromoiodide grains with a higher molar proportion of iodide in the core of the grain than in the periphery of the grain, such as those described in U.K. Patent No. 1,027,146; Japanese Patent 54/48521; U.S. Pat. Nos. 4,379,837; 4,444,877; 4,565,778; 4,636,461; 4,665,012; 4,668,614; 4,686,178; and 4,728,602; and in European Patent 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized, by a noble metal (for example, gold), middle chalcogen (such as sulfur, selenium or tellurium), and reduction sensitizers, employed individually or in combination. Typical chemical sensitizers are listed in Research Disclosure, Item 308119, Section III.

The silver halide emulsions can be spectrally sensitized with dyes from a variety of classes, including the polymethine dye class, which includes the cyanines, merocyanines, complex cyanines and merocyanines (such as tri-, tetra- and polynuclear cyanines and merocyanines), oxonols, hemioxonols, styryls, merostyryls and streptocyanines. Illustrative spectral sensitizing dyes are described in Research Disclosure, Item 308119, Section IV, and the publications cited therein.

Suitable vehicles for the emulsion layers and other layers of the elements according to the invention are described in Research Disclosure, Item 308119, Section IX, and the publications cited therein.

The photographic elements according to the invention can include additional couplers such as those described in Research Disclosure Section VII, paragraphs D-G, and the publications cited therein. These additional couplers can be incorporated as described in Research Disclosure Section VII, paragraph C, and the publications cited therein. The coupler according to the invention can be used with colored masking couplers such as described in U.S. Pat. No. 4,883,746, with image modifying couplers such as described in U.S. Pat. Nos. 3,148,062; 3,227,554; 3,733,201; 4,409,323; and 4,248,962 and with couplers that release bleach accelerators such as described in European Patent Application 193,389.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

The photographic elements according to the invention can be coated on a variety of supports as described in Research Disclosure Section XVII and the references cited therein. These supports include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. The oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-$\beta$-(methanesulfonamido)-ethylaniline sulfatehydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N-(2-methoxyethyl)-m-toluidine-di-p-toluenesulfonate.

With negative-working silver halides, the process step described above leads to a negative image. If used in color negative film the described elements are preferably processed in the known C-41 color process as described in, for example, the British Journal of Photography Annual of 1988, pages 196–198. To obtain a positive (or reversal) image, the color development step can be preceded by developing with a non-chromogenic developing agent to develop exposed silver halide but not form dye, and then uniformly fogging the element to render unexposed silver halide developable, followed by developing with a chromogenic developer. Alternatively, a direct-positive emulsion can be employed to obtain a positive image. Other known processes can be used depending on the type of photographic element the coupler is used in.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent, such as water, soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The invention is further illustrated by the following examples, without being limited thereby. In the examples the following pivaloylacetanilide coupler was used as a comparative example.

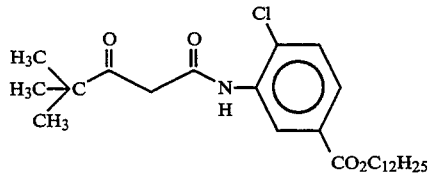

C-1

Preparation of Photographic Elements

Dispersions of the couplers were prepared in the following manner. The quantities of each component are found in Table I. In one vessel, the coupler, coupler solvent (dibutyl phthalate), and ethyl acetate were combined and warmed to dissolve. In a second vessel, the gelatin, Alkanol XC TM (E. I. DuPont Co.) and water were combined and warmed to about 40° C. The two mixtures were mixed together and passed three times through a Gaulin colloid mill. The ethyl acetate was removed by evaporation and water was added to restore the original weight after milling.

TABLE I

| Dispersion No. | Coupler No. | Grams Coupler | Grams Coupler Solvent | Grams Ethyl Acetate | Grams 12.5% Gelatin | Grams Alkanol XC (10%) | Grams Water |
|---|---|---|---|---|---|---|---|
| 1 (invention) | Y-1 | 1.556 | 0.778 | 4.669 | 17.76 | 1.78 | 10.46 |
| 2 (invention) | Y-2 | 1.536 | 0.768 | 4.607 | 17.76 | 1.78 | 10.55 |
| 3 (comparative) | C-1 | 1.516 | 0.758 | 4.547 | 17.76 | 1.78 | 10.64 |

The photographic elements were prepared by coating the following layers in the order listed on a resin-coated paper support:

| | |
|---|---|
| 1st Layer | |
| Gelatin | 3.23 g/m$^2$ |
| 2nd Layer | |
| Gelatin | 1.61 g/m$^2$ |
| Coupler Dispersion (See Table II) | 1.18 × 10$^{-3}$ mole coupler/m$^2$ |
| Blue-sensitized AgCl emulsion | 0.56 g Ag/m$^2$ |
| 3rd Layer | |
| Gelatin | 1.33 g/m$^2$ |
| 2-(2H-benzotriazol-2-yl)-4,6-bis-(1,1-dimethylpropyl)phenol | 0.73 g/m$^2$ |
| Tinuvin 326 TM (Ciba-Geigy) | 0.13 g/m$^2$ |
| 4th Layer | |
| Gelatin | 1.40 g/m$^2$ |
| Bis(vinylsulfonylmethyl) ether | 0.14 g/m$^2$ |

Exposing and Processing of Photographic Elements

The photographic elements were given stepwise exposures to green light and processed as follows at 35° C.:

Developer: 45 seconds

Bleach-Fix: 45 seconds

Wash (running water): 1 minute, 30 seconds

The developer and bleach-fix were of the following compositions:

| | |
|---|---|
| Developer | |
| Water | 700.00 mL |
| Triethanolamine | 12.41 g |
| Blankophor REU TM (Mobay Corp.) | 2.30 g |
| Lithium Polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl)ethylamino]ethyl}-methanesulfonamide, sesquisulfate | 5.00 g |
| 1-Hydroxyethyl-1,1-diphosphonic acid (60%) | 0.81 g |
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.4 ± 0.05 | |
| Bleach-Fix | |
| Water | 700.00 mL |
| Solution of ammonium thiosulfate (54.4%) + Ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 6.7 | |

Photographic Tests

Yellow dyes were formed upon processing. The following photographic characteristics were determined: D-max (the maximum density to blue light); Speed (the relative log exposure required to yield a density to blue light of 1.0); and Contrast (the ratio (S-T)/0.6, where S is the density at a log exposure 0.3 units greater than the Speed value and T is the density at a log exposure 0.3 units less than the Speed value).

Normalized spectra of the resulting dyes were prepared by reading the spectra at a density of approximately 1.0 and at the minimum density of the processed strip, then subtracting the minimum density spectrum from the 1.0 density spectrum to produce a "stain-subtracted" spectrum, and finally dividing the density at each wavelength of the stain-subtracted spectrum by the maximum density of the stain-subtracted spectrum. The wavelength of the peak absorption of the normalized spectrum is called Lambda-max.

The values of D-max, Contrast, Speed, and Lambda-max are shown in Table II. The normalized spectra are shown in FIG. 1.

TABLE II

| Example No. | Dispersion | Coupler | D-max | Contrast | Speed | Lambda-max |
|---|---|---|---|---|---|---|
| 1 (invention) | 1 | Y-1 | 1.70 | 1.96 | 136 | 431 |
| 2 (invention) | 2 | Y-2 | 1.99 | 2.22 | 134 | 427 |
| 3 | 3 | C-1 | 1.33 | 1.11 | 103 | 446 |

TABLE II-continued

| Example No. | Dispersion | Coupler | D-max | Contrast | Speed | Lambda-max |
|---|---|---|---|---|---|---|
| (comparative) | | | | | | |

The data show that the couplers of the invention produced higher densities and speeds than the comparison coupler, and that the absorption spectra of the dyes from the couplers of the invention were hyposochromically shifted relative to the spectrum of the dye from the comparison coupler. FIG. 1 shows that the dye from the couplers of the invention have much less absorption in the green region of the spectrum (500–600 nm) than the dyes from the comparison coupler.

The invention has been described in detail with particular reference to preferred embodiments thereof, but it will be understood that variations and modifications can be effected within the spirit and scope of the invention.

What is claimed is:

1. A photographic element comprising a support and a silver halide emulsion layer having associated therewith a coupler of the formula

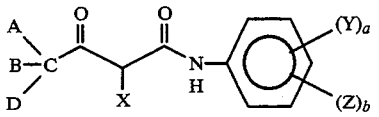

wherein A, B, and D is are each fluorine atoms,

X is a hydrogen atom or a coupling-off group, and

Y and Z are independently selected from the group consisting of H, Cl, F, Br, CN, carboxy, $NO_2$, $CF_3$, substituted or unsubstituted alkoxycarbonyl, substituted or unsubstituted aryloxycarbonyl, —S(O)N($R^2$)$_2$, —S(O)$_2$N($R^2$)$_2$, —S(O)$R^3$, —S(O)$_2R^3$, —N$R^2$S(O)$R^3$, —N$R^2$S(O)$_2R^3$, —NHCONH$R^3$, NHCO$R^3$, —N$R^2$S(O)N($R^2$)$_2$, —N$R^2$S(O)$_2$N($R^2$)$_2$, —O$R^3$, —OC$R^1$($R^2$)$_2$, —O(CH$_2$)$_n R^3$, —O(CH$_2$—CH$_2$—O)$_n R^2$, —O(CH$_2$—CH$_2$—O)$_n$COO$R^2$, —O(CH$_2$—CH$_2$—O)$_n$CON($R^2$)$_2$, —C$R^1R^2$COO$R^2$, —C$R^1R^2$CON($R^2$)$_2$, —COO(CH$_2$—CH$_2$—O)$_n R^2$ and a ballast group; where each $R^1$, $R^2$, $R^3$ independently is hydrogen alkyl, alkoxy, aryl, or aryloxy, any of which may be substituted or unsubstituted; and n is an integer and wherein a and b are integers from 1 to 4, inclusive.

2. A photographic element as claimed in claim 1, wherein X is selected from the group consisting of H, halogen, substituted or unsubstituted aryloxy, substituted or unsubstituted alkoxy, substituted or unsubstituted acyloxy, and nitrogen hetorocyclic compounds.

3. A photographic element as claimed in claim 1, wherein said coupler is of the formula

1)

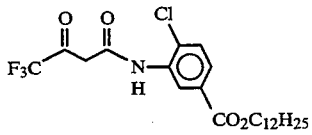

2)

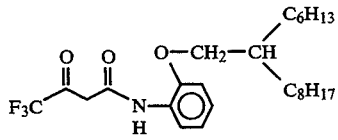

-continued

3)

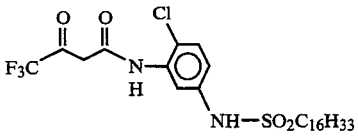

4)

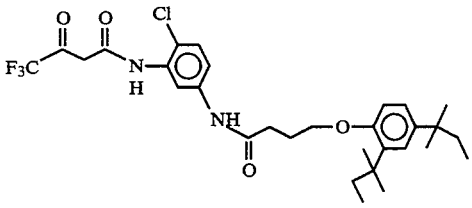

5)

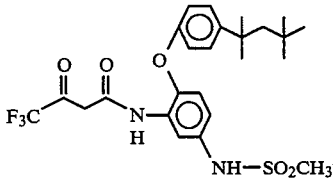

6)

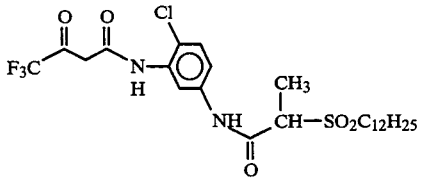

7)

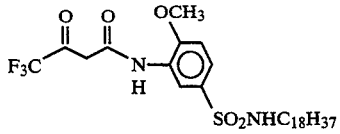

8)

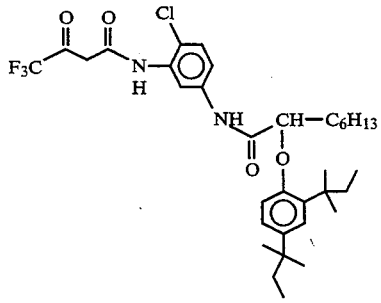

9)

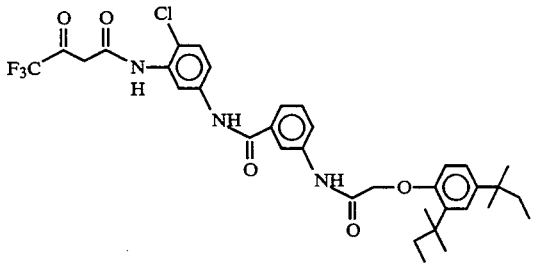

or

-continued

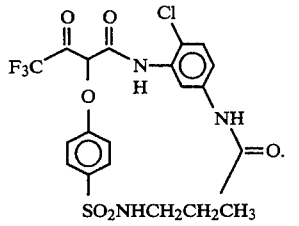

4. A photographic element as claimed in claim 3 wherein said coupler is of the formula 1 or 2.

5. A photographic element as claimed in claim 1, wherein X is -$(TG)_x$-PUG wherein TG is a timing group, cleavable from the rest of the coupler during processing, x is 0, 1, 2, or 3, and PUG is a releasable photographically useful group.

6. A photographic element as claimed in claim 5, wherein x is at least 1.

7. A photographic element as claimed in claim 5, wherein PUG is a dye, such that the coupler is a masking coupler.

8. A photographic element as claimed in claim 7, wherein the auxochromic group of the dye is blocked.

9. A photographic element as claimed in claim 5, wherein the coupler is ballasted.

10. A multi-color photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye forming coupler, wherein the element further comprises a coupler of the formula

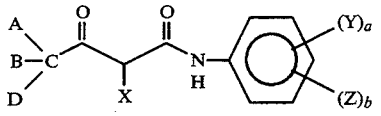

wherein A, B and D are each fluorine atoms,

X is a hydrogen atom or a coupling-off group, and

Y and Z are independently selected from the group consisting of H, Cl, F, Br, CN, carboxy, $NO_2$, $CF_3$, substituted or unsubstituted alkoxycarbonyl, substituted or unsubstituted aryloxycarbonyl, —S(O)N$(R^2)_2$, —S(O)$_2$N$(R^2)_2$, —S(O)$R^3$, —S(O)$_2R^3$, —N$R^2$S(O)$R^3$, —N$R^2$S(O)$_2R^3$, —NHCONH$R^3$, NHCO$R^3$, —N$R^2$S(O)N$(R^2)_2$, —N$R^2$S(O)$_2$N$(R^2)_2$, —O$R^3$, —OC$R^1(R^2)_2$, —O$(CH_2)_nR^3$, —O$(CH_2$—$CH_2$—O$)_nR^2$, —O$(CH_2$—$CH_2$—O$)_n$COO$R^2$, —O$(CH_2$—$CH_2$—O$)_n$CON$(R^2)_2$, —C$R^1R^2$COO$R^2$, —C$R^1R^2$CON$(R^2)_2$, —COO$(CH_2$—$CH_2$—O$)_nR^2$ and a ballast group; wherein each $R^1$, $R^2$, $R^3$ independently is hydrogen, alkyl, alkoxy, aryl or aryloxy, any of which may be substituted or unsubstituted; and n is an integer and wherein a and b are integers from 1 to 4, inclusive.

11. A multi-color photographic element as claimed in claim 10, wherein X is -$(TG)_x$-PUG wherein TG is a timing group, cleavable from the rest of the coupler during processing, x is 0, 1, 2, or 3, and PUG is a releasable photographically useful group.

12. A process for developing an image in a photographic element comprising a support and a silver halide emulsion containing an image-wise distribution of developable silver halide grains, said process comprising the step of developing agent in the presence of a coupler of the formula

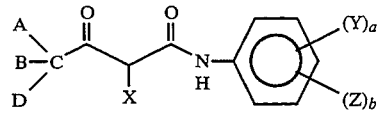

wherein A, B and D are each fluorine atoms,

X is a hydrogen atom or a coupling-off group, and

Y and Z are independently selected from the group consisting of H, Cl, F, Br, CN, carboxy, $NO_2$, $CF_3$, substituted or unsubstituted alkoxycarbonyl, substituted or unsubstituted aryloxycarbonyl, —S(O)N$(R^2)_2$, —S(O)$_2$N$(R^2)_2$, —S(O)$R^3$, —S(O)$_2R^3$, —N$R^2$S(O)$R^3$, —N$R^2$S(O)$_2R^3$, —NHCONH$R^3$, NHCO$R^3$, —N$R^2$S(O)N$(R^2)_2$, —N$R^2$S(O)$_2$N$(R^2)_2$, —O$R^3$, —OC$R^1(R^2)_2$, —O$(CH_2)_nR^3$, —O$(CH_2$—$CH_2$—O$)_nR^2$, —O$(CH_2$—$CH_2$—O$)_n$COO$R^2$, —O$(CH_2$—$CH_2$—O$)_n$CON$(R^2)_2$, —C$R^1R^2$COO$R^2$, —C$R^1R^2$CON$(R^2)_2$, —COO$(CH_2$—$CH_2$—O$)_nR^2$ and a ballast group; wherein each $R^1$, $R^2$, $R^3$ independently is hydrogen, alkyl, alkoxy, aryl or aryloxy, any of which may be substituted or unsubstituted; and n is an integer and wherein a and b are integers from 1 to 4, inclusive.

13. A process as claimed in claim 12:

wherein X is -$(TG)_x$-PUG wherein TG is a timing group, cleavable from the rest of the coupler during processing, x is 0, 1, 2, or 3, and PUG is a releasable photographically useful group.

14. A photographic silver halide emulsion containing a coupler of the formula

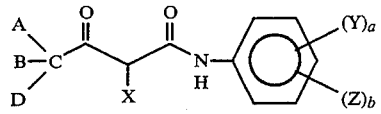

wherein A, B and D are each fluorine atoms,

X is a hydrogen atom or a coupling-off group, and

Y and Z are independently selected from the group consisting of H, Cl, F, Br, CN, carboxy, $NO_2$, $CF_3$, substituted or unsubstituted alkoxycarbonyl, substituted or unsubstituted aryloxycarbonyl, —S(O)N$(R^2)_2$, —S(O)$_2$N$(R^2)_2$, —S(O)$R^3$, —S(O)$_2R^3$, —N$R^2$S(O)$R^3$, —N$R^2$S(O)$_2R^3$, —NHCONH$R^3$, NHCO$R^3$, —N$R^2$S(O)N$(R^2)_2$, —N$R^2$S(O)$_2$N$(R^2)_2$, —O$R^3$, —OC$R^1(R^2)_2$, —O$(CH_2)_nR^3$, —O$(CH_2$—$CH_2$—O$)_nR^2$, —O$(CH_2$—$CH_2$—O$)_n$COO$R^2$, —O$(CH_2$—$CH_2$—O$)_n$CON$(R^2)_2$, —C$R^1R^2$COO$R^2$, —C$R^1R^2$CON$(R^2)_2$, —COO$(CH_2$—$CH_2$—O$)_nR^2$ and a ballast group; wherein each $R^1$, $R^2$, $R^3$ independently is hydrogen, alkyl, alkoxy, aryl or aryloxy, any of which may be substituted or unsubstituted; and n is an integer and wherein a and b are integers from 1 to 4, inclusive.

15. A photographic silver halide emulsion as claimed in claim 14 wherein X is $-(TG)_x$-PUG wherein TG is a timing group, cleavable from the rest of the coupler during processing, x is 0, 1, 2, or 3, and PUG is a releasable photographically useful group.

* * * * *

UNITED STATES PATENT AND TRADEMARK OFFICE

CERTIFICATE OF CORRECTION

PATENT NO. : 5,360,713

DATED : November 1, 1994

INVENTOR(S) : Ping W. Tang, et al.

It is certified that error appears in the above-indentified patent and that said Letters Patent is hereby corrected as shown below:

Col 17, line 31, delete "is".

Col 17, line 45, delete "where", and insert --- wherein ---.

line 45, after "hydrogen" insert --- , ---.

Col 20, line 10, after "developing", insert --- said element with a silver halide color developing ---.

Signed and Sealed this

Twenty-fourth Day of January, 1995

Bruce Lehman

*Attest:*

BRUCE LEHMAN

*Attesting Officer*

*Commissioner of Patents and Trademarks*